United States Patent [19]

Hodges

[11] Patent Number: 4,589,863

[45] Date of Patent: May 20, 1986

[54] CYLINDER FOR A ROTARY WEB PROCESSING MACHINE

[75] Inventor: William D. Hodges, London, England

[73] Assignee: Machines Chambon S.A., Orleans, France

[21] Appl. No.: 603,202

[22] Filed: Apr. 23, 1984

[30] Foreign Application Priority Data

Apr. 28, 1983 [GB] United Kingdom ..... 8311566

[51] Int. Cl.[4] ..... B31B 47/00

[52] U.S. Cl. ..... 493/471; 83/332; 493/60

[58] Field of Search ..... 493/60, 324, 365, 367, 493/370, 471; 83/678, 347, 332; 101/DIG. 19, 226, 227, 426

[56] References Cited

U.S. PATENT DOCUMENTS 1,777,285 10/1930 Adsit ..... 493/60

3,752,042 8/1973 Castille ..... 493/471

*Primary Examiner*—W. D. Bray

*Attorney, Agent, or Firm*—Fitch, Even, Tabin & Flannery

[57] ABSTRACT

A cylinder for a rotary web processing machine comprises a mandrel and a plurality of multi-part rings detachably fixed thereto. Each part of each ring is fixed to the mandrel by first and second screws. Each first screw is effective to clamp the associated ring part to the mandrel and to locate that ring part both radially and axially. Each second screw is effective to clamp the associated ring part to the mandrel.

9 Claims, 3 Drawing Figures

CYLINDER FOR A ROTARY WEB PROCESSING MACHINE

BACKGROUND TO THE INVENTION

This invention relates to a cylinder for a rotary web processing machine, and in particular to a cylinder which is constituted by a mandrel and a plurality of cutting and/or creasing rings detachably fixed thereto.

Rotary web processing machines are used for creasing and/or cutting webs of board, for example, for forming carton blanks. Such a machine has a pair of cylinders which are rotatably mounted in a frame in such a manner that the rings of the two cylinders are in alignment. The web to be processed is passed through the nip between the two cylinders, so that the web is creased and/or cut as it passes through the machine.

When cutting and/or creasing webs to form carton blanks, it is common practice to separate the functions of longitudinal cutting and/or creasing from those of transverse cutting and/or creasing. This is in order to alter one set of functions without affecting the other, or to facilitate independent adjustment of the penetration of the creasing and/or cutting surfaces of the rings into the web. In particular, it is often important to be able to move each of the rings accurately and interchangeably into different predetermined positions. Moreover, many rotary web processing machines require frequent ring changes to be made. For example, when making milk carton blanks, it is frequently desirable to change the lateral pitch of the creasing rings which form the tops and bases of the cartons. By changing the lateral positions of these creasing rings, it is possible to make milk cartons which have the same repeat lengths but are of different predetermined widths.

The cylinders of many known rotary web processing machines have one-piece creasing rings which are threaded onto a key-wayed mandrel, the lateral positions of the rings being determined by spacing rings (or tubes) positioned between adjacent pairs of creasing rings. Consequently, when it is required to re-position the creasing rings on the mandrel of such a cylinder, it is necessary to carry out the following steps:

(a) the mandrels must be removed from the web processing machine;

(b) the creasing rings and spacing rings must then be removed from the mandrels;

(c) the creasing rings must be replaced on the mandrels with different spacing rings positioned therebetween; and (d) the mandrel must then be repositioned in the web processing machine.

Obviously, this process is very time consuming, and so is extremely disadvantageous when frequent ring changes must be made.

In order to avoid the difficulties with this type of cylinder, it is known to use two-part creasing rings which can be clamped to a mandrel in a variety of positions. The two parts (segments) of each ring can be drawn together to clamp that ring to the mandrel using parallel screws across the adjoining surfaces of the segments. This method of drawing the segments together is often inconvenient, in that it is difficult to arrange for the screw heads to be accessibly positioned on the periphery of the segments. Moreover, although the rings can generally be positioned anywhere along the axis of the mandrel, radial location is difficult. Thus, radial location is generally provided by a key and slot arrangement between the mandrel and each ring, and this is invariable without the provision of further attachments. The rings may be held in predetermined positions by means of spacers positioned therebetween. Alternatively, this can be accomplished by dowel pins fixed to the segments and extending towards the corresponding segments of the adjacent ring.

Alternatively, the segments of each ring can be fixed to the mandrel by radial screws. In this case, two dowel pins are used for axial and radial location of each of the segments. Here again, however, it is extremely difficult to vary the radial location of each of the rings. In particular, unless the two dowel pins of each segment are parallel, they would have to be retractable to enable the segments to be removed. Retractable dowel pins complicate the arrangement and add to the number of steps required to fit and remove the rings. Thus, when frequent ring changes are necessary, this type of fitting is disadvantageous. Moreover, the constant insertion and removal of the dowel pins leads to excessive wear of the bores provided for them in the mandrel. The provision of parallel dowel pins would mean providing non-radial bores in the mandrel, and this would entail great difficulties in ensuring accurate radial location of the rings in interchangeable positions. Thus, although cylinders of this type permit relatively easy axial repositioning of the creasing rings, they suffer from a major disadvantage that it is extremely difficult, if not impossible, to position the creasing rings accurately (in both radial and axial directions) in different predetermined positions. Moreover, cylinders of this type are not suitable where frequent ring changes are necessary. (Cylinders of this type are described in U.S. Specification No. 1547214 & GB Patent Specification No. 871450).

The aim of the invention is to provide a cylinder for a rotary web processing machine whose rings can easily be removed and re-positioned accurately in both radial and axial directions, without requiring its mandrel to be removed from its bearings.

SUMMARY OF THE INVENTION

The present invention provides a cylinder for a rotary web processing machine, the cylinder comprising a mandrel and a plurality of multi-part rings detachably fixed thereto, wherein each part of each ring is fixed to the mandrel by first and second screws, each first screw being effective to clamp the associated ring part to the mandrel and to locate that ring part both radially and axially, each second screw being effective to clamp the associated ring part to the mandrel.

Preferably, each of the rings is of two-part construction, each of said parts being a half ring.

Preferably, the mandrel is provided with a plurality of sets of threaded bores, the bores of each set being adapted to receive the screws of one of said rings, there being a greater number of sets of bores than there are rings, and the sets of bores being spaced along the mandrel so that the rings can be fixed to the mandrel at different spacings.

Preferably, each first screw is received with respective bushes mounted in apertures formed in the associated ring part and the mandrel, each of the apertures in the mandrel being aligned with a respective threaded bore. Preferably, the bushes are made of harder material than the rings and the mandrel.

Advantageously, the adjacent edge portions of each pair of adjacent ring parts are formed with aligned grooves, a respective key being positioned within each pair of aligned grooves to align the associated ring parts. Preferably, each key is detachably connected to the associated ring parts by means of screws.

BRIEF DESCRIPTION OF THE DRAWINGS

A web processing machine incorporating two cylinders constructed in accordance with the invention will now be described, by way of example, with reference to the accompanying drawings, in which.

DESCRIPTION OF PREFERRED EMBODIMENTS

Figure 1:
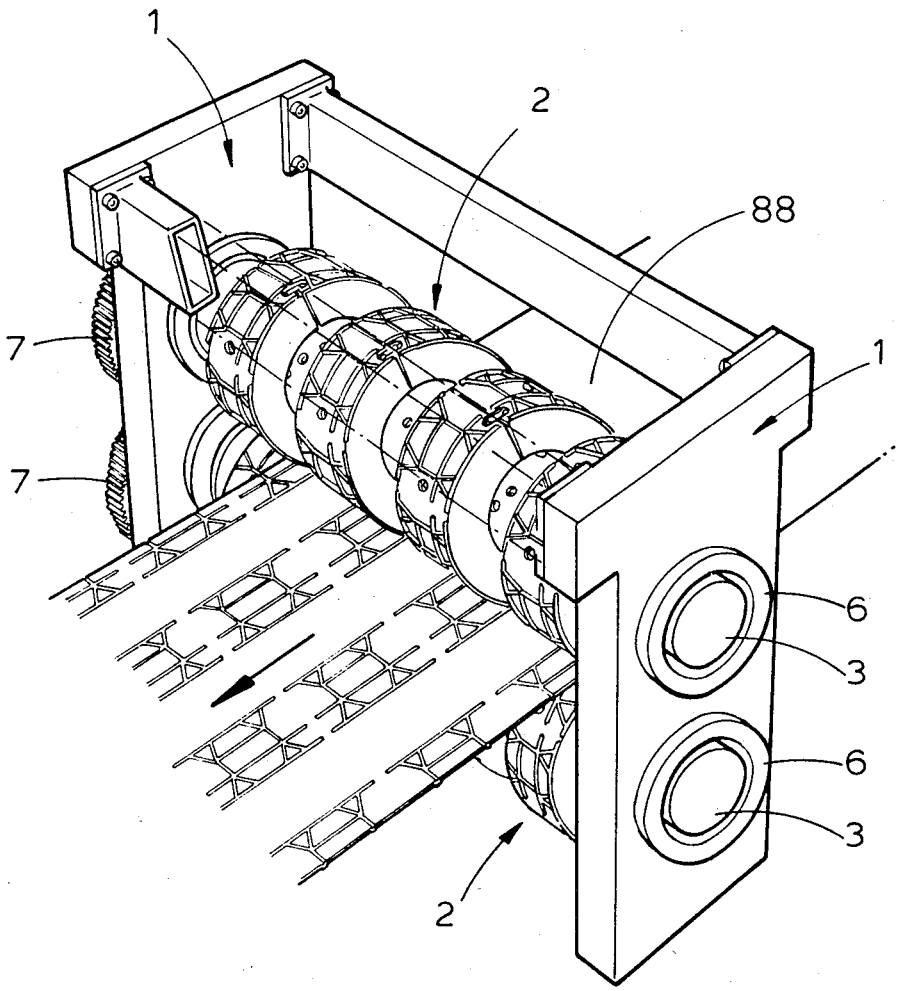
FIG. 1 is a perspective view of part of the machine.

Referring to the drawings, FIG. 1 shows a cylinder assembly of a rotary web processing machine which is used for forming the crease markings on milk carton blanks. This assembly is removably mounted in the frame of the machine (not shown). The assembly has a pair of side plates 1 which rotatably support a pair of cylinders 2. Each of the cylinders 2 is constituted by a cylindrical shaft 3, a hollow tubular mandrel 4 fixed to the shaft 3, and four creasing rings 5 detachably fixed to the mandrel. The end portions of the shafts 3 are supported in the side plates 1 by means of bearings 6. At one side of the assembly the free ends of the shafts 3 are provided with gear wheels 7. The gear wheels 7 intermesh so that, when one of the gear wheels is driven from the machine by a motor (not shown), the two shafts 3 rotate in opposite directions in synchronism. The shafts 3 are mounted in the side plates 1 in such a manner that the creasing rings 5 of the two cylinders 2 define a nip through which a web 88 of board can pass. One of the cylinders 2 is arranged to be vertically adjustable, so that the size of the nip can be varied. This enables webs of different thicknesses to be processed by the machine, and also permits the degree of penetration of the creasing rings 5 into the web 88 to be varied.

Figure 3:
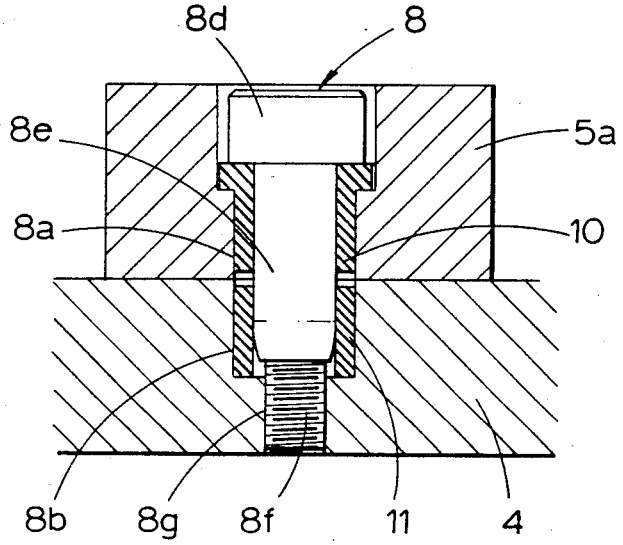
FIG. 3 is a sectional view showing the method of connecting a creasing ring to the mandrel of one of the cylinders.

Each of the creasing rings 5 is constituted by two identical parts 5*a*. Each ring part 5*a* is detachably fixed to the mandrel 4 by means of two screws 8 and 9. Each screw 8 is an axial and radial locating screw and a clamping screw, and each screw 9 is a radial clamping screw. The radial clamping screws 9 pass through aligned apertures 9*a* and 9*b* formed respectively in the associated ring part 5*a* and the mandrel 4. Each axial and radial locating and clamping screw 8 passes through hardened bushes 10 and 11 formed respectively in aligned apertures 8*a* and 8*b* formed respectively in the associated ring part 5*a* and the mandrel 4. As shown in FIG. 3, the apertures 8*a* and 8*b* are stepped, and the screws 8 each have a head 8*d*, a smooth cylindrical shank 8*e* and a threaded shank 8*f*. The threaded shank 8*f* of each screw 8 engages within a threaded portion 8*g* of the associated aperture 8*b* in the mandrel 4.

The cylindrical surface of each ring part 5*a* is formed with a respective key slot 12. The two key slots 12 of one part 5*a* of each ring 5 are adapted to be aligned with the key slots 12 of the other part 5*a* of that ring. A respective key 13 is provided for engaging within each pair of aligned key slots 12, and a pair of screws 14 are provided for fixing each of the keys to the associated ring parts 5*a*. The keys 13 are used to hold the ring parts 5*a* together prior to assembly of the rings 5 onto the mandrel 4.

Figure 2:
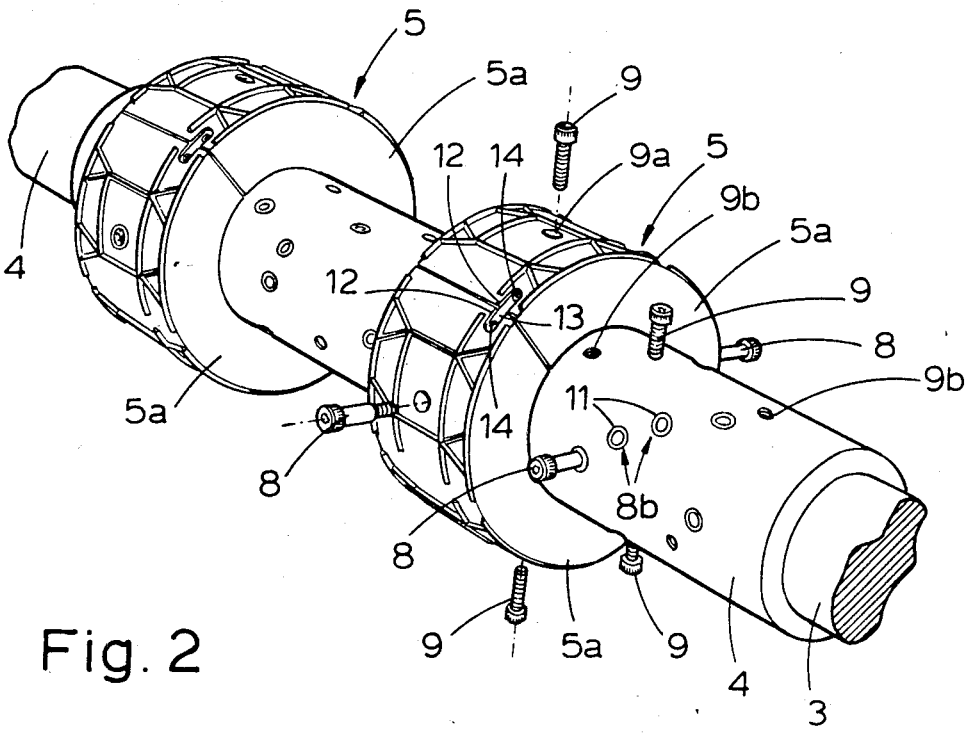
FIG. 2 is a perspective view of part of one of the cylinders of the machine of FIG. 1.

As shown best in FIG. 2, the mandrel 4 is provided with a plurality of sets of apertures 8*b* and 9*b*, each set having a pair of diametrically opposed apertures 8*b* for accommodating the screws 8, and a pair of diametrically opposed apertures 9*b* for accommodating the screws 9. The mandrel 4 is provided with a considerably greater number of sets of apertures 8*b* and 9*b* than there are rings 5, so that the rings 5 can be fixed to the mandrel at different locations and spacings.

In order to fix a ring 5 on its mandrel 4, the two parts 5*a* thereof are loosely held together by engaging the keys 13 in the aligned key slots 12, and by loosely threading in the fixing screws 14. The two axial and radial locating and clamping screws 8 are then threaded through the apertures 8*a* in the rings parts 5*a*, and into the apertures 8*b* in the mandrel 4. The cylindrical shanks 8*e* of the screws 8 engage within the bushes 10 and 11 to effect accurate alignment of the rings parts 5*a* both radially and axially with respect to the mandrel 4. The screw threaded portions 8*f* and 8*g* then engage to clamp the rings parts 5*a* to the mandrel 4. The radial clamping screws 9 are then screwed into position to clamp the rings parts 5*a* firmly to the mandrel 4. The screws 14 are then tightened up to complete the fixing of the ring 5.

If a ring 5 is required to be repositioned (for example where the rings 5 of a given cylinder 2 have to be repositioned laterally in order to make milk carton blanks of different widths), it is necessary only to loosen the screws 14 to remove the screws 8 and 9, to slide the ring along the mandrel 4 to the new position, and then to replace the screws 8 and 9 and retighten the screws 14. Obviously, this procedure is considerably simpler and less time-consuming than the equivalent procedure for replacing the one-piece creasing rings of the known type of web processing machine. In particular, there is no need to remove the cylinders 2 from the assembly to carry out the lateral repositioning of the creasing rings 5. Moreover, the provision of the axial and radial locating and clamping screws 8 ensures that the rings 5 are always accurately positioned both axially and radially. Moreover, the repositioning process is both rapid and easy, so frequent ring changes cause no problems. In this connection, the provision of the hardened bushes 10 and 11 substantially reduces wear, and so increases the life of the mandrel. Obviously, where the repositioning of the creasing rings 5 requires the addition of one or more rings 5 this can easily be accomplished by fixing the two parts 5*a* of a new ring onto the mandrel 4 at the required position. Similarly, where a ring 5 needs to be removed, this is easily accomplished by completely removing the screws 14 of the ring concerned, and separating the two ring parts 5*a* of that ring.

I claim:

1. A cylinder for a rotary web processing machine, the cylinder comprising a mandrel and a plurality of multi-part rings detachably fixed thereto, wherein each part of each ring is fixed to the mandrel by first and second screws, each first screw clamping the associated ring part to the mandrel and locating that ring part both radially and axially, each second screw clamping the associated ring part to the mandrel, wherein each of the rings is of two-part construction, each of said parts being a half ring.

2. A cylinder according to claim 1, wherein the mandrel is provided with a plurality of sets of threaded bores, the bores of each set being adapted to receive the screws of one of said rings, there being a greater number of sets of bores than there are rings, and the sets of bores being spaced along the mandrel so that the rings can be fixed to the mandrel at different spacings.

3. A cylinder according to claim 1, wherein each first screw is received within respective bushes mounted in apertures formed in the associated ring part and the mandrel, each of the apertures in the mandrel being aligned with a respective threaded bore.

4. A cylinder according to claim 3, wherein the bushes are made of harder material than the rings and the mandrel.

5. A cylinder according to claim 1, wherein the adjacent edge portions of each pair of adjacent ring parts are formed with aligned grooves, a respective key being positioned within each pair of aligned grooves to align the associated ring parts.

6. A cylinder according to claim 5, wherein each key is detachably connected to the associated ring parts by means of screws.

7. A cylinder for a rotary web processing machine, the cylinder comprising a mandrel and a plurality of multi-part rings detachably fixed thereto, wherein each part of each ring is fixed to the mandrel by first and second screws, each first screw clamping the associated ring part to the mandrel and locating that ring part both radially and axially, each second screw clamping the associated ring part to the mandrel, wherein the mandrel includes a plurality of sets of threaded bores, the bores of each set being adapted to receive the screws of one of said rings, there being a greater number of sets of bores than there are rings, and the sets of bores being spaced along the mandrel so that the rings can be fixed to the mandrel at different spacings.

8. A cylinder for a rotary web processing machine, the cylinder comprising a mandrel and a plurality of multi-part rings detachably fixed thereto, wherein each part of each ring is fixed to the mandrel by first and second screws, each first screw clamping the associated ring part to the mandrel and locating that ring part both radially and axially, each second screw clamping the associated ring part to the mandrel, wherein each first screw is received within respective bushes mounted in apertures formed in the associated ring part and the mandrel, each of the apertures in the mandrel being aligned with a respective threaded bore.

9. A cylinder for a rotary web processing machine, the cylinder comprising a mandrel and a plurality of multi-part rings detachably fixed thereto, wherein each part of each ring is fixed to the mandrel by first and second screws, each first screw clamping the associated ring part to the mandrel and locating that ring part both radially and axially, each second screw clamping the associated ring part to the mandrel, wherein the adjacent edge portions of each pair of adjacent ring parts are formed with aligned grooves, a respective key being positioned within each pair of aligned grooves to align the associated ring parts.

* * * * *